US005902093A

United States Patent [19]

Liotta et al.

[11] Patent Number: 5,902,093

[45] Date of Patent: May 11, 1999

[54] CRACK ARRESTING ROTOR BLADE

[75] Inventors: Gary C. Liotta, Beverly; Paul J. Acquaviva, Maldon; Leston M. Freeman, Jr., S. Hamilton; Robert F. Manning, Newburyport, all of Mass.

[73] Assignee: General Electric Company, Cincinnati, Ohio

[21] Appl. No.: 08/916,386

[22] Filed: Aug. 22, 1997

[51] Int. Cl.[6] ..... B63H 1/14

[52] U.S. Cl. ..... 416/97 R; 416/90 R; 416/92; 415/115; 415/121.2; 415/169.1

[58] Field of Search ..... 416/90 R, 92, 416/97 R; 415/115, 121.2, 169.1

[56] References Cited

U.S. PATENT DOCUMENTS

| | | | |
|---|---|---|---|
| 3,807,892 | 4/1974 | Frei et al. | 415/116 |
| 4,390,320 | 6/1983 | Eiswerth | 416/97 R |
| 4,474,532 | 10/1984 | Pazder | 416/97 R |
| 4,753,575 | 6/1988 | Levengood | 416/97 R |
| 4,761,116 | 8/1988 | Braddy et al. | 416/92 |
| 4,820,122 | 4/1989 | Hall et al. | 416/97 R |
| 5,125,798 | 6/1992 | Muth et al. | 416/92 |
| 5,183,385 | 2/1993 | Lee et al. | 416/97 R |
| 5,326,224 | 7/1994 | Lee et al. | 416/97 R |
| 5,403,159 | 4/1995 | Green et al. | 416/97 R |
| 5,462,405 | 10/1995 | Hoff et al. | 416/97 R |
| 5,660,523 | 8/1997 | Lee | 416/97 R |
| 5,660,524 | 8/1997 | Lee et al. | 416/97 R |

*Primary Examiner*—Christopher Verdier
*Assistant Examiner*—Ninh Nguyen
*Attorney, Agent, or Firm*—Andrew C. Hess; David L. Narciso

[57] ABSTRACT

A rotor blade includes a dovetail and an airfoil joined thereto. The airfoil includes first and second spaced apart sides joined together laterally at opposite leading and trailing edges, and spanwise at a root and opposite tip. A serpentine cooling circuit extends inside the airfoil for channeling air therethrough for cooling the blade. The serpentine circuit includes first and second passes and a first bend therebetween for firstly receiving the cooling air in turn from the dovetail. A tip circuit is disposed between the tip and the serpentine circuit at the first bend for separating the tip from the first bend and providing cooling thereof near the trailing edge.

13 Claims, 3 Drawing Sheets

CRACK ARRESTING ROTOR BLADE

BACKGROUND OF THE INVENTION

The present invention relates generally to gas turbine engines, and, more specifically, to turbine rotor blades therein.

In a gas turbine engine, a plurality of turbine rotor blades are mounted around the perimeter of a rotor disk and receive combustion gases from a combustor for extracting energy therefrom and powering the rotor disk. Since the blades are subjected to hot combustion gases during operation, they are typically cooled by providing cooling circuits therein which receive a portion of pressurized air bled from a compressor disposed upstream from the combustor.

The first stage turbine blade found in the high pressure turbine mounted immediately downstream of the combustor receives the hottest combustion gases and therefore requires the greatest amount of cooling for ensuring a useful life. Each blade includes a dovetail which removably mounts the blade to the rotor perimeter, with an airfoil having pressure and suction sides extending radially outwardly from the dovetail. One or more air inlets are provided in the dovetail and are suitably joined in flow communication with the compressor for receiving a portion of the air therefrom for use in cooling the airfoil. The airfoil includes various cooling circuits therein which circulate the cooling air from root to tip of the airfoil and between leading and trailing edges thereof.

The airfoil includes various apertures or holes through the pressure and suction sides for discharging the cooling air typically as a film for providing film cooling to protect the outer surface of the airfoil from the hot combustion gases flowable thereover. The airfoil typically includes holes in its tip which also discharge a portion of the cooling air. Some of the tip holes are center mounted between the pressure and suction sides and are relatively large in diameter for allowing any dust contained in the cooling air to be withdrawn from the airfoil without clogging the various cooling holes therein which are substantially smaller in diameter than the dust holes.

Over extended operation of the airfoil, a crack may develop in the tip thereof and propagate radially inwardly. If the crack breaches the internal cooling channels, the cooling air may leak therethrough and adversely affect the intended cooling of the blade. For example, the airfoil may include a multi-pass serpentine cooling circuit which extends radially upwardly and downwardly in serpentine passes, with the cooling air being channeled therethrough cooling the airfoil and increasing in temperature along the length of the serpentine circuit. If the tip crack reaches the serpentine circuit at one of its passes, the downstream passes may be deprived of a portion of the cooling air intended therefor which can cause an increase in operating temperature of the airfoil and accelerate propagation of the tip crack leading to an undesirably shortened blade life.

Accordingly, it is desired to provide a crack arresting feature in the airfoil which does not interfere or degrade effective cooling of the blade for enhancing blade life.

SUMMARY OF THE INVENTION

A rotor blade includes a dovetail and an airfoil joined thereto. The airfoil includes first and second spaced apart sides joined together laterally at opposite leading and trailing edges, and spanwise at a root and opposite tip. A serpentine cooling circuit extends inside the airfoil for channeling air therethrough for cooling the blade. The serpentine circuit includes first and second passes and a first bend therebetween for firstly receiving the cooling air in turn from the dovetail. A tip circuit is disposed between the tip and the serpentine circuit at the first bend for separating the tip from the first bend and providing cooling thereof near the trailing edge.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
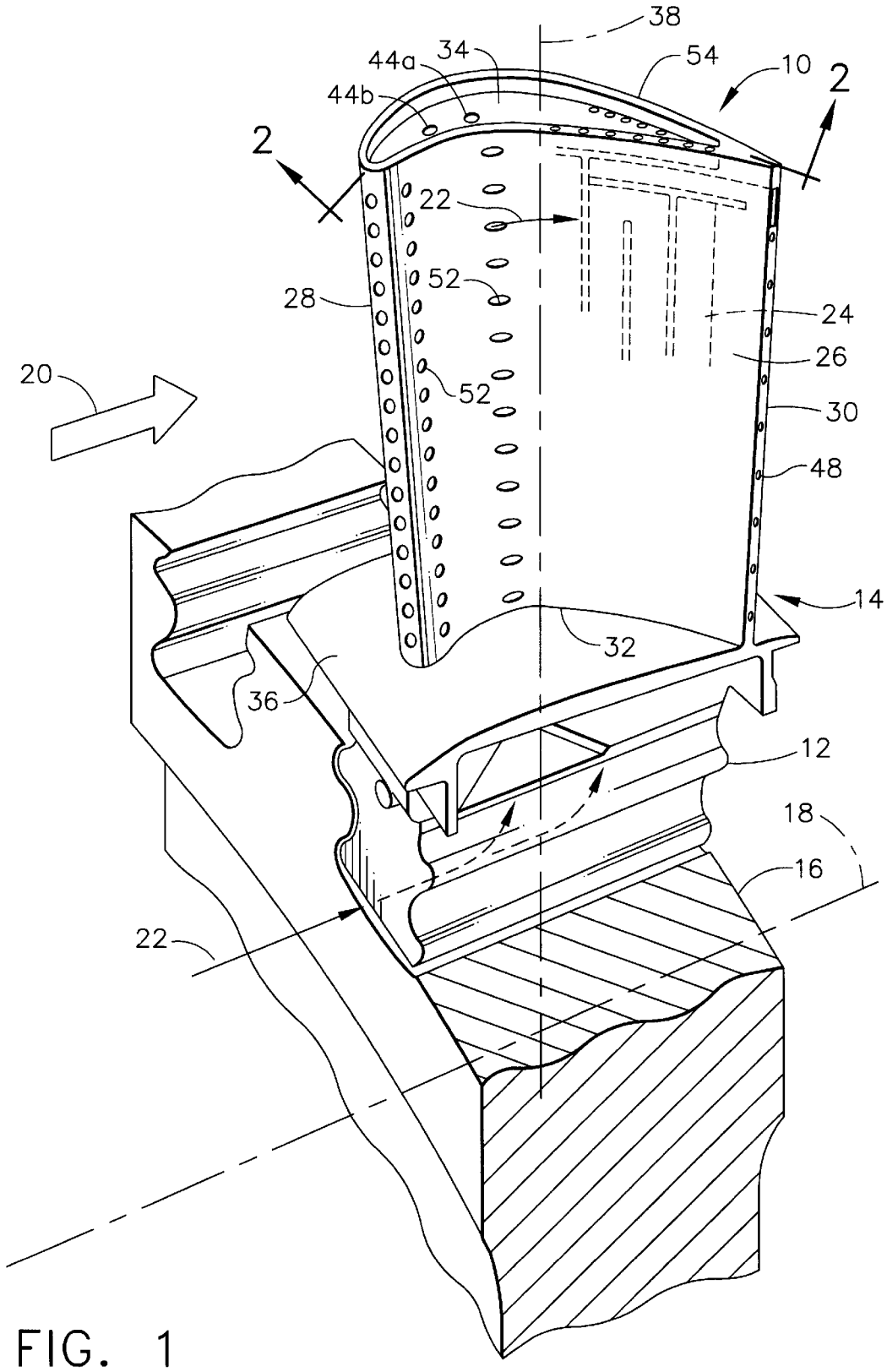
FIG. 1 is an isometric view of an exemplary gas turbine engine rotor blade mounted to the perimeter of a rotor disk, shown in part, by a dovetail, with an airfoil extending radially outwardly therefrom.

Illustrated in FIG. 1 is a gas turbine engine rotor blade 10 in accordance with an exemplary embodiment of the present invention. The blade 10 includes a dovetail 12 which may take any conventional form such as the axial entry dovetail illustrated, from which extends radially outwardly an integral hollow airfoil 14 which may be conventionally formed therewith in a one-piece casting. The blade 10 is one of many which are removably mounted to a conventional rotor disk 16, only a portion of which is illustrated, having an axial centerline axis 18. The blades 10 and disk 16 are suitably mounted in the gas turbine engine downstream of the combustor thereof (not shown), with the exemplary blade 10 illustrated in FIG. 1 being a first stage high pressure turbine rotor blade.

During operation, the combustor produces hot combustion gases 20 which flow through a turbine nozzle (not shown) and are directed over the airfoil 14 which extracts energy therefrom for rotating the disk 16 and producing useful work. The airfoil 14 is cooled using pressurized cooling air 22 suitably bled from a compressor (not shown) of the engine which is channeled to the rotor disk 16 and blades 10 in a conventional manner.

The airfoil 14 includes laterally, or circumferentially spaced apart first and second sides 24, 26, with the first side 24 defining a suction side which is generally convex, and the second side 26 defining a pressure side which is generally concave. The two sides 24, 26 are joined together laterally at their opposite axial ends at corresponding leading and trailing edges 28, 30. The two sides 24, 26 also extend radially or spanwise and are joined together at a root 32 at the top of the dovetail 12, and at a radially opposite tip 34 which is in the form of a thin plate closing the top of the airfoil. A suitable platform 36 surrounds the airfoil 14 at its root junction with the dovetail 12 to provide a lower boundary for the combustion gases 20 in a conventional manner. The leading and trailing edges 28, 30 are spaced apart axially relative to the centerline axis 18, with the root 32 and tip 34 being spaced radially along a radial or span axis 38.

Figure 2:
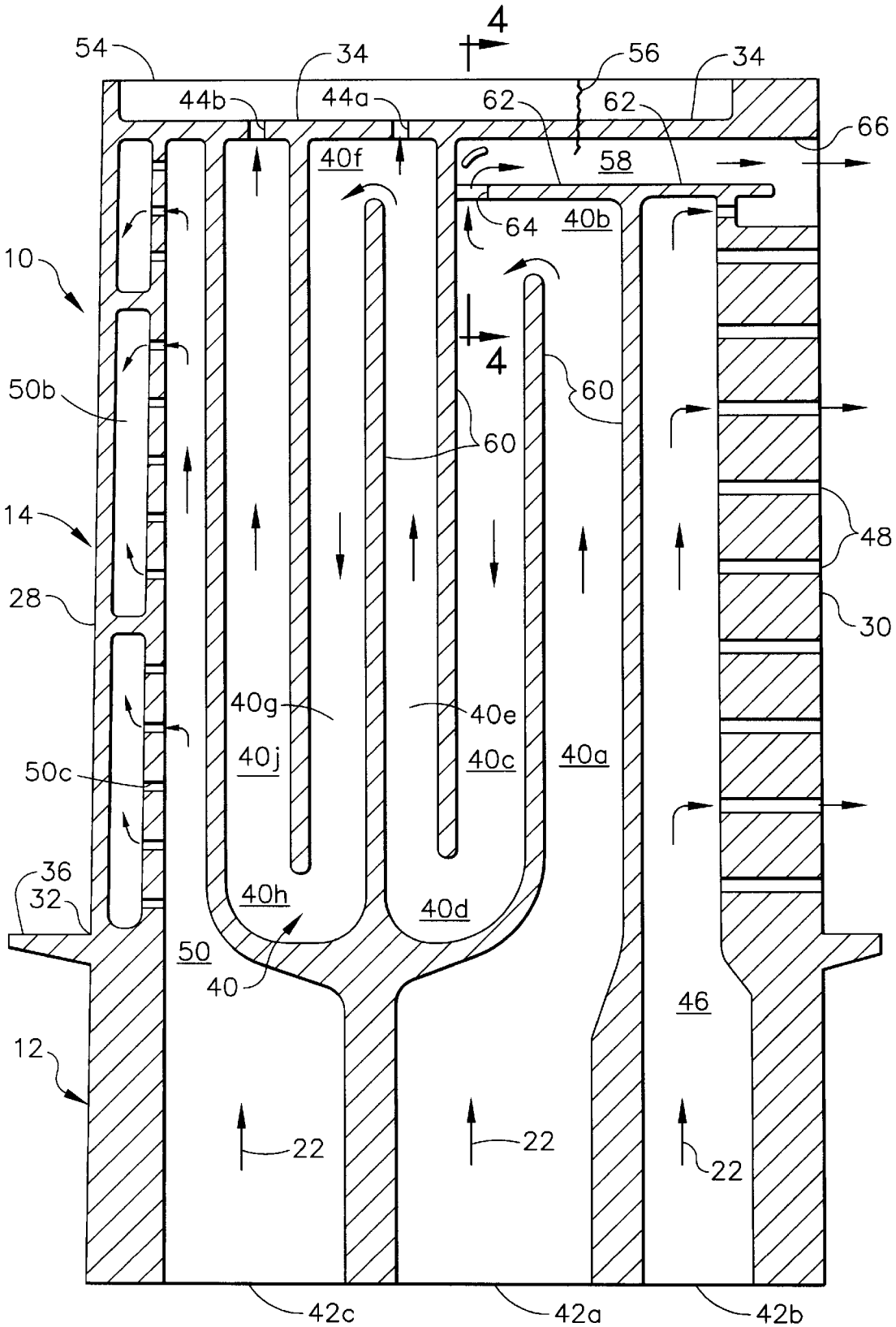
FIG. 2 is an elevational sectional view through the turbine blade illustrated in FIG. 1 and taken along line 2—2 showing cooling circuits therein including a tip circuit in accordance with an exemplary embodiment of the present invention.

The inside of the airfoil 14 is illustrated in more particularity in an exemplary configuration in FIG. 2 and includes a multi-pass serpentine cooling circuit or channel 40 which extends spanwise from the dovetail 12 and inside the airfoil 14 for channeling the cooling air 22 therethrough for cooling the blade 10 during operation. In the exemplary embodiment illustrated in FIG. 2, the serpentine circuit 40 is a five-pass circuit including a first pass 40*a* extending radially outwardly to a first bend or turn 40*b* which in turn is disposed in flow communication with a second pass 40*c* extending radially inwardly from the first bend 40*b*. The serpentine circuit 40 in the exemplary embodiment illustrated in FIG. 2 is disposed mid-chord between the airfoil leading and trailing edges 28, 30 and has a center inlet 42*a* at the bottom of the dovetail 12 for receiving the cooling air 22.

The cooling air 22 at the center inlet 42*a* initially flows radially outwardly through the first pass 40*a* and increases in temperature as it cools the airfoil 14. The cooling air 22 changes direction in the first bend 40*b* and flows radially inwardly through the second pass 40*c* to a second bend 40*d* near the airfoil root 32 which again changes direction of the cooling air 22 radially upwardly through a third pass 40*e*. A third bend 40*f* is located below the tip 34 in flow communication with the third pass 40*e* which again turns the cooling air 22 radially inwardly through a fourth pass 40*g* which extends to the airfoil root 32 wherein a fourth bend 40*h* is disposed for turning the cooling air radially outwardly through a fifth and final pass 40*j* which extends radially outwardly to the tip 34. The tip 34 includes conventional apertures or holes 44*a,b* through which the cooling air 22 from the serpentine circuit 40 is discharged in a conventional manner.

As the cooling air 22 flows through the multi-pass serpentine circuit 40 it cools the airfoil 14 and is thereby heated with its temperature increasing in each of the successive passes in turn until it is discharged through the fifth pass 40*j* and out the tip hole 44*b*.

In the exemplary embodiment illustrated in FIGS. 1 and 2, the airfoil 14 is subjected to high heat load and therefore high temperature near its trailing edge 30. The serpentine circuit 40 therefore initially introduces the cooling air 22 nearer the trailing edge 30 than the leading edge 28 and winds axially forwardly toward the leading edge 28 in a conventional manner. In this way, increased cooling effectiveness of the air 22 is used at the hotter trailing edge region, with the warmed cooling air 22 in the subsequent passes being sufficient for cooling the leading edge passage of the airfoil 14.

In the exemplary embodiment illustrated in FIG. 2, the airfoil 14 also includes an independent trailing edge cooling circuit 46 which is in the form of a simple straight channel extending radially outwardly from a trailing edge inlet 42*b* in the base of the dovetail 12 for providing an alternate path for another portion of the cooling air 22 received from the compressor. The trailing edge cooling circuit 46 also includes a plurality of radially spaced apart outlets or holes 48 along the trailing edge 30 which communicate therewith for discharging in an axially aft direction the cooling air 22 channeled through the trailing edge cooling circuit 46. In this way, an independent portion of the cooling air 22 is directed to the airfoil 14 along its trailing edge 30 for providing enhanced cooling thereof.

Similarly, the exemplary blade 10 further includes a leading edge cooling circuit 50 in the form of a straight channel extending radially outwardly from an inlet 42*c* in the base of the dovetail 12 which independently receives another portion of the cooling air 22 for specifically cooling the airfoil 14 along its leading edge 28. The leading edge cooling circuit 50 may take any conventional form such as that illustrated including a plurality of leading edge plenums 50*b* fed by a plurality of cross holes 50*c* communicating with the main channel. As shown in FIG. 1, the outer surface of the airfoil 14 may include various film cooling holes 52 which may communicate with the leading edge cooling circuit 50 for providing discharge of the cooling air therefrom, as well as communicating with the serpentine cooling circuit 40 in any conventional manner.

In this way, the airfoil 14 may be configured with at least one serpentine cooling circuit, and dedicated leading and trailing edge cooling circuits if desired for promoting effecting cooling of the various portions of the airfoil 14 between leading and trailing edges and root and tip. The basic cooling circuits of the airfoil 14 may take any conventional configuration, but are modified in accordance with the present invention for arresting crack propagation from the tip 34 without adversely affecting cooling of the airfoil especially near the critical trailing edge region subjected to high heat influx.

In the exemplary embodiment illustrated in FIGS. 1 and 2, the blade tip 34 includes a conventional squealer rib 54 which extends radially outwardly therefrom along the first and second sides 24, 26 and between the leading and trailing edges 28, 30 to define a radially outwardly facing tip pocket. The squealer ribs 54 are conventional in structure and function and allow the airfoil 14 to be positioned closely adjacent to a surrounding stator shroud (not shown) for minimizing leakage of the combustion gases 20 therebetween. The squealer ribs 54 may rub against the shroud under certain transient conditions for protecting the tip and maintaining integrity of the cooling circuits in the airfoil.

An exemplary radial tip crack 56 is illustrated in FIG. 2 as propagating radially inwardly from the squealer rib 54 and through the tip 34. In a conventional turbine blade, the tip crack 56 could reach the serpentine cooling circuit causing leakage of the cooling air therefrom which adversely affects the cooling ability of the downstream serpentine passes thereof. This bypassing of the cooling air from the downstream portions of the serpentine circuit will cause a rise in temperature of the airfoil which could enhance crack propagation rate and lead to a shorter life of the blade.

In accordance with the present invention, an axial tip cooling circuit 58 is disposed entirely radially between the tip 34 and a portion of the serpentine circuit 40 at the first bend 40*b*, and entirely axially between the second pass 40*c* and the trailing edge 30 for separating the tip 34 from the first bend 40*b* in this critical region of the airfoil near the trailing edge to provide a safety pocket or channel for intercepting any tip crack propagating radially inwardly theretoward. The tip circuit 58 also provides improved cooling of the airfoil 14 below the tip 34 at the trailing edge 30 which is effective for decreasing the propagation rate of any tip crack 56 formed in this region. In this way, performance of the serpentine circuit 40 is uncoupled in part from the tip 34 near the trailing edge 30 in the region of high heat influx for maintaining cooling effectiveness of the serpentine circuit without compromise in the event of the tip crack 56 above the tip circuit 58.

In the preferred embodiment illustrated in FIG. 2, the serpentine third pass 40*e* extends radially from the root 32 to the tip 34 and is spaced forwardly of the tip circuit 58. The serpentine circuit 40 is defined in lateral part by the opposite airfoil sides 24, 26, and in axial part by a plurality of radially extending legs or ribs 60 extending between the root 32 and the tip 34. The legs 60 are spaced apart between the leading and trailing edges of the airfoil and define the chord-wise or axial extent of the several serpentine passes in the form of channels or conduits.

The leg 60 between the second and third passes 40*c,e* extends radially inwardly from the tip 34 to the second bend 40*d*, and its outer portion defines the forwardmost portion of the tip circuit 58 separating it axially from the remainder of the serpentine passes.

The airfoil further includes a tip septum or rib 62 which is spaced radially inwardly from the tip 34, and is integrally joined to a pair of the legs 60 at the first bend 40*b*. At the upstream end of the tip septum 62 is disposed an inlet 64 in flow communication with the first bend 40*b* for receiving a portion of the cooling air 22 therefrom to feed the tip cooling circuit 58. The tip circuit includes an outlet 66 preferably disposed at the trailing edge 30 near the blade tip for discharging the cooling air 22 in a generally aft direction.

Figure 3:
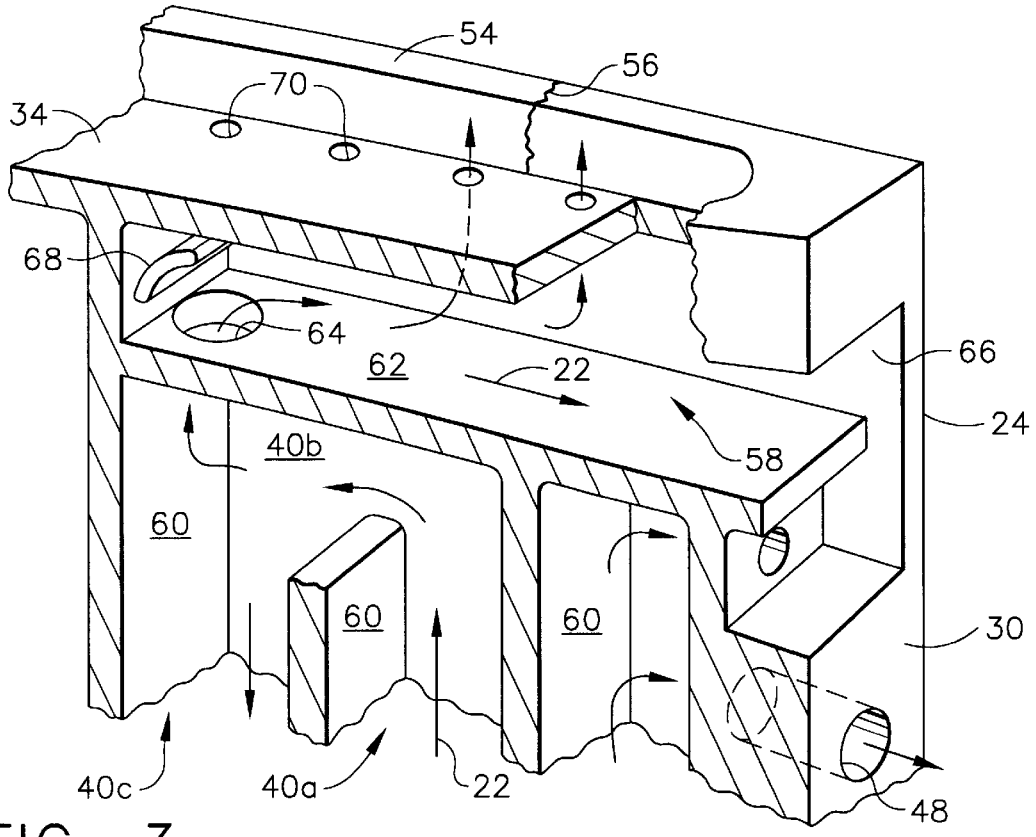
FIG. 3 is an isometric view of the tip circuit portion of the airfoil illustrated in FIG. 2 in enlarged scale.

As shown in more particularity in FIG. 3, the tip circuit inlet 64 may be in the form of a simple circular hole through the septum 62 and is sized in diameter to meter a predetermined portion of the cooling air 22 from the first bend 40*b* to feed the tip circuit 58. The serpentine second pass 40*c* is joined in flow communication with the first bend 40*b* to receive the entire remainder of the cooling air 22 channeled therethrough. The tip circuit outlet 66 may have any suitable form such as a relatively large aperture through the trailing edge 30 for discharging the cooling air 22 from the tip circuit 58 with minimum pressure loss.

In this way, a portion of the cooling air 22 from the serpentine first pass 40*a* feeds the tip circuit 58 with the coolest available airflow, except for the nominal heating thereof which occurs in the first pass 40*a*. For example, the temperature of the cooling air 22 in the first bend 40*b* is about 28° C. cooler than the cooling air discharged from the end of the trailing edge cooling circuit 46. This relatively cool air fed to the tip circuit 58 not only improves cooling of the airfoil 14 below the tip 34 at the trailing edge 30, but also helps slow the propagation rate of any tip crack 56 thereat.

The tip circuit inlet 64 is preferably disposed at the forwardmost end of the tip septum 62 at the junction with the corresponding leg 60 so that the cooling air flows primarily aft through the tip circuit 58 and out the trailing edge outlet 66. A conventional flow guide 68 may be disposed inside the tip circuit 58 above the inlet 64 to initially deflect and turn the cooling air in the aft direction.

By preferentially locating the tip circuit 58 above the first and second passes 40*a,c* of the serpentine circuit 40, it is fed with relatively cool air and ensures integrated performance of the serpentine circuit. In the event the tip crack 56 propagates inwardly into the tip circuit 58, only the cooling air from the tip circuit 58 is available to leak through the crack, which air is relatively cool for cooling the crack and slowing its propagation. Since the tip circuit inlet 64 is a metering hole which feeds the tip circuit 58 upstream of the crack 56, the cooling air channeled in turn through the multiple passes of the serpentine circuit 40 is unaffected and undiminished by the crack itself. In this way, enhanced cooling of the airfoil is maintained even in the event of a tip crack above the tip circuit 58.

In the preferred embodiment illustrated in FIG. 3, the tip circuit inlet 64 is preferably also sized to remove dust entrained with the cooling air 22 from the first bend 40*b*, and the tip 34 is characterized by the absence of conventional relatively large dust holes disposed in flow communication with the tip circuit 58 or the serpentine circuit 40. Conventional dust holes are relatively large, for example greater than about 0.6 mm, and would otherwise be centered between the two sides of the airfoil in the tip 34 for removing dust and preventing blocking by the dust of the relatively smaller cooling holes typically used in the airfoil. By sizing the tip circuit inlet 64 for dust extraction, conventional dust holes may be eliminated from the tip 34 which provides the additional advantage of enhanced tip cooling since the air channeled through the tip circuit 58 provides cooling therein, whereas air discharged from typical dust holes in the tip 34 provide little effective cooling since they simply dump the air overboard.

Figure 4:
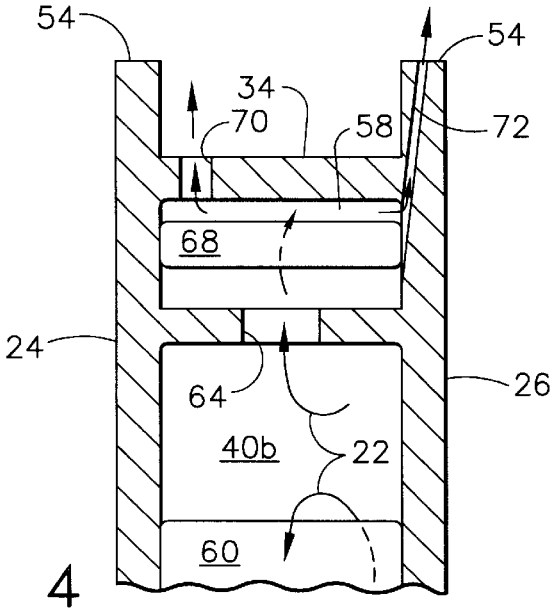
FIG. 4 is an elevational sectional view through the tip circuit illustrated in FIG. 2 and taken generally along line 4—4.

As shown in FIGS. 3 and 4, the tip 34 may also include a plurality of conventional small impingement cooling holes 70 disposed in flow communication with the tip circuit 58 along the airfoil first side 24 for discharging the air 22 in impingement against the squealer rib 54. The impingement holes 70 provide additional outlets for the tip circuit 58 besides the trailing edge outlet 66. However, the impingement holes 70 provide enhanced cooling since they may be preferentially located adjacent the squealer rib 54 for enhanced cooling thereof.

Similarly, a plurality of small tip holes 72 may be inclined through the airfoil second wall 26 and outwardly through the squealer rib 54 therealong in flow communication with the tip circuit 58 for providing enhanced cooling in a conventional fashion. And, the tip circuit may also include radial turbulators to provide enhanced cooling. In this way, the tip circuit 58 may be used with conventional cooling features for enhancing cooling of the airfoil in its vicinity while also providing a safety pocket for arresting tip cracks without degrading cooling performance of the airfoil.

As illustrated in FIG. 2, the tip circuit 58 is preferentially located below the tip 34 from about the mid-chord of the airfoil 12 to the trailing edge 30 in a known region of high heat influx and high stress. The remainder of the serpentine circuit 40 from its third pass 40*e* forwardly, and the leading edge circuit 50 are disposed axially between the leading edge 28 and the tip circuit 58 in any conventional configuration for cooling the forward portion of the airfoil as desired.

Since it is desirable to position the tip circuit 58 below the tip 34 to the trailing edge 30, the trailing edge cooling circuit 46 may otherwise have a conventional form that terminates radially inwardly of the tip circuit 58 as illustrated. The trailing edge circuit 46 extends from the dovetail 12 radially outwardly and terminates at the tip septum 62. The tip circuit outlet 66 is therefore disposed at the trailing edge 30 radially outwardly of the trailing edge circuit 46 including its trailing edge holes 48. In the exemplary embodiment illustrated, the trailing edge holes 48 are radially aligned with the tip circuit outlet 66, with all these holes discharging in the aft direction.

By introducing the tip circuit 58 into the otherwise conventional turbine blade 10, various advantages accrue. The tip circuit 58 provides a buffer or safety pocket between the airfoil tip 34 and the serpentine circuit 40 between mid-chord and the trailing edge in a region of known high temperature. Accordingly, any tip cracks initiated in this region are intercepted by the tip circuit 58 which protects normal operation of the serpentine circuit 40 without cooling degradation from the cracks. The tip circuit 58 is directly cooled by the cooling air 22 from the first bend 40*b* of the serpentine circuit to enhance cooling effectiveness in this region. The relatively cool airflow through the tip circuit 58 reduces crack propagation rate as compared to using higher temperature air in this region. And, the tip circuit 58 provides an alternate discharge from the serpentine circuit for removing dust which may replace the relatively large conventional dust holes otherwise found in the tip 34. Dust removal is accomplished through the tip circuit 58 while additionally circulating the removed air therethrough for providing enhanced cooling effectiveness of the removed air without simply dumping overboard the air as would occur with conventional dust holes.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

1. A turbine rotor blade comprising:

a dovetail for mounting said blade to a rotor disk;

an airfoil joined to said dovetail, and having spaced apart first and second sides joined together laterally at opposite leading and trailing edges and spanwise at a root and an opposite tip;

a serpentine cooling circuit extending spanwise inside said airfoil for channeling air therethrough for cooling said blade, said serpentine circuit having first and second passes and a first bend therebetween for firstly receiving said cooling air in turn from said dovetail; and a tip circuit disposed between said tip and said serpentine circuit at said first bend, and solely between said second pass and said trailing edge, and having an inlet disposed in flow communication with said first bend for receiving a portion of said cooling air therefrom, and an outlet at said trailing edge for discharging said air therethrough for separating said tip from said first bend and providing cooling thereof near said trailing edge.

2. A blade according to claim 1 wherein said serpentine circuit further includes a third pass joined in flow communication with said second pass at a second bend therebetween, and extending to said tip forwardly of said tip circuit.

3. A blade according to claim 2 wherein said tip circuit inlet is sized to meter a portion of said air from said first bend to said tip circuit, with said second pass being joined to said first bend to receive a remainder of said air therefrom.

4. A blade according to claim 3 wherein said tip circuit inlet is sized to remove dust entrained with said air from said first bend, and said tip is characterized by the absence of dust holes disposed in flow communication with said tip circuit.

5. A blade according to claim 3 wherein said tip includes a plurality of cooling holes disposed in flow communication with said tip circuit along said airfoil first side for discharging said air in addition to said tip circuit outlet.

6. A blade according to claim 5 wherein said tip includes a squealer rib extending outwardly therefrom along said first and second sides between said leading and trailing edges, and said tip holes are aligned with said airfoil first side to effect cooling thereof.

7. A blade according to claim 3 wherein:

said serpentine circuit is defined by a plurality of legs extending between said root and tip; and said airfoil further includes a tip septum spaced inwardly from said tip, and joined to a pair of said legs at said first bend.

8. A blade according to claim 7 wherein said serpentine circuit further includes a fourth pass disposed in flow communication with said third pass at a third bend therebetween, and a fifth pass disposed in flow communication with said fourth pass at a fourth bend therebetween, with said fourth and fifth passes being disposed between said leading edge and said tip circuit.

9. A blade according to claim 8 further comprising a trailing edge cooling circuit extending from said dovetail to said tip septum, and said tip circuit outlet is disposed at said trailing edge outwardly of said trailing edge cooling circuit.

10. A blade according to claim 9 wherein said trailing edge cooling circuit includes a plurality of outlets along said trailing edge aligned with said tip circuit outlet.

11. A blade according to claim 3 wherein said tip circuit includes a single inlet.

12. A blade according to claim 11 wherein said tip circuit inlet is disposed at a forwardmost end of said tip circuit.

13. A blade according to claim 7 wherein said septum is imperforate except for a single tip circuit inlet at a forwardmost end thereof.

* * * * *